US006786182B2

(12) United States Patent
Morgandi et al.

(10) Patent No.: US 6,786,182 B2
(45) Date of Patent: Sep. 7, 2004

(54) PRESSURE CONTROL FOR HOUSEHOLD STEAM GENERATOR

(75) Inventors: Arturo Morgandi, Bergamo (IT); Diego Pietra, Dalmine (IT)

(73) Assignee: Imetec, S.p.A., Azzano S. Paolo (IT)

( * ) Notice: Subject to any disclaimer, the term of this patent is extended or adjusted under 35 U.S.C. 154(b) by 0 days.

(21) Appl. No.: 10/398,103

(22) PCT Filed: Jul. 27, 2001

(86) PCT No.: PCT/IT01/00414

§ 371 (c)(1),
(2), (4) Date: Apr. 1, 2003

(87) PCT Pub. No.: WO03/012337

PCT Pub. Date: Feb. 13, 2003

(65) Prior Publication Data

US 2004/0040185 A1 Mar. 4, 2004

(51) Int. Cl.[7] ..... F24H 1/20

(52) U.S. Cl. ..... 122/4 A; 122/506; 392/451; 392/453

(58) Field of Search ..... 122/36, 31.1, 31.2, 122/504, 506, 4 A; 392/451, 453; 236/56

(56) References Cited

U.S. PATENT DOCUMENTS 4,368,694 A * 1/1983 Ward et al. ..... 122/504
4,377,737 A * 3/1983 Berry ..... 392/401
5,367,605 A * 11/1994 Violi ..... 392/401
5,386,100 A * 1/1995 McNair ..... 219/437
5,692,096 A * 11/1997 Massey et al. ..... 392/464
6,643,454 B1 * 11/2003 Rochelle ..... 392/485

FOREIGN PATENT DOCUMENTS

EP 0 423 540 A1 4/1991 ..... F22B/1/28
EP 0 478 508 A1 4/1992 ..... F22B/1/28

* cited by examiner

*Primary Examiner*—Gregory Wilson
(74) *Attorney, Agent, or Firm*—Husch & Eppenberger, LLC; Robert C. Haldiman

(57) ABSTRACT

A household appliance for steam generation with a boiler containing a heating source for water vaporization intended to be partly immersed in water; a control means for adjusting the pressure valve of the steam in the boiler that operatively associated with the heating source to switch on or off so as to maintain the steam pressure at a desired value; and a steam delivering means. The means for adjusting the pressure value in the boiler is operatively associated with the steam delivery means so as to switch the heating source on and off in function of the open or closed status of the steam delivery means.

16 Claims, 5 Drawing Sheets

PRESSURE CONTROL FOR HOUSEHOLD STEAM GENERATOR

"This application claims priority to PCT Application Number PCT/IT01/000414."

DESCRIPTION

The present invention relates to a household appliance for steam generation, comprising a boiler-in turn comprising a heating source for water vaporisation-steam delivery means, and means for adjusting the pressure value of the steam in the boiler, suitable for switching the heating source on/off so as to maintain the steam pressure at a desired value.

The present invention also relates to a method for adjusting the pressure value of the steam in a boiler of a household appliance for steam generation.

Household appliances for steam generation are known.

Typically, such household appliances comprise a heating source for vaporising the boiler water, and means for maintaining a desired pressure value and a desired water level in the boiler.

Document DE 37 20 583 describes an appliance for steam generation comprising a water vaporisation boiler, a pump for feeding water to the boiler, a heating source wound as a spiral around the boiler, two temperature sensors, also wound as a spiral around the boiler, a manometer and a pressure regulator. One of the two sensors is used to detect the heating source temperature and draw water into the boiler when the detected temperature exceeds a first threshold temperature. The second sensor is used to detect the heating source temperature and turn it off when the detected temperature exceeds a second threshold temperature that is higher than the first threshold temperature. The manometer and the pressure regulator are, on the other hand, used for maintaining a desired value of steam pressure in the boiler.

Patent application PCT/ITOO/00112 filed by the Applicant, describes an apparatus for steam generation comprising a water vaporisation boiler, a pump for feeding water to the boiler, a heating source having an elevated portion, a temperature sensor in contact with such elevated portion, and a manometer with associated respective control means. The sensor is used to detect the heating source temperature and draw water into the boiler when the detected temperature exceeds a threshold temperature. In turn, the manometer is used to detect the steam pressure in the boiler, and the control means is used to switch the heating source on/off in function of the pressure value detected by the manometer, so as to maintain a desired steam pressure value in the boiler.

However, the use of the manometer for adjusting the water pressure value in the boiler of the appliances described by the above documents has the disadvantage of implying high costs. Moreover, the manometer exhibits the disadvantage of being relatively cumbersome.

The Applicant has thus faced the technical problem of realising a household appliance for steam generation at reduced costs and cumber.

Thus, in a first aspect thereof, the present invention relates to a household appliance for steam generation, comprising a boiler comprising, in turn, a heating source for water vaporisation, intended to be at least partly immersed in water, control means comprising, in turn, means for adjusting the pressure value of the steam in the boiler, said means being operatively associated with the heating source to switch it on/off so as to maintain the steam pressure at a desired value, steam delivering means, characterised in that the means for adjusting the pressure value in the boiler is operatively associated with the steam delivery means so as to switch the heating source on/off in function of the open/closed status of the steam delivery means.

The pressure adjusting means of the appliance of the invention regulate the pressure value in the boiler through a simple control of the status (open/closed) of the steam delivery means.

Such function can be performed by simple circuit diagrams which, with respect to the use of a manometer, allow the costs and cumber of the appliance to be reduced.

In the present description and claims, the expression "standby condition" is used to indicate the situation in which the heating source is immersed in water, the steam pressure in the boiler substantially has the desired value, the boiler is ready to deliver steam and the steam delivery means is closed. In turn, the expression "steam delivery condition" is used to indicate the situation in which the boiler delivers steam, for example, to a user equipment, and the steam delivery means is open or in its opening or closing transient.

Typically, the boiler also comprises a temperature sensor suitable for detecting the heating source temperature.

Preferably, the sensor is in contact with the heating source.

Advantageously, the means for adjusting the pressure value in the boiler is operatively connected to the temperature sensor so as to switch the heating source on/off in function of the temperature value detected by the sensor (12) when the steam delivery means status is closed.

To this purpose, the Applicant notes that when the boiler is in standby condition, the water present into the boiler is in saturation conditions, so that pressure and temperature are connected to one another by a bi-univocal correspondence. Moreover, the temperature detected by the temperature sensor is substantially equivalent to the water temperature. It is thus possible to maintain the desired pressure value in function of the temperature value detected by the sensor.

On the other hand, during the initial heating of the appliance, when the temperature of the water present in the boiler is less than that detected by the temperature sensor, the sensor detects a higher temperature than the actual water temperature. As a consequence, the heating source is switched on/off a certain number of times before reaching the standby desired pressure value. However, this is not a problem since if a user requires steam delivery when the pressure in the boiler has not reached the desired value yet, the means for adjusting the pressure value would keep the heating source on during the opening time of the steam delivery means (see below), thus bringing the pressure to the desired value.

Advantageously, the means for adjusting the pressure value in the boiler is suitable for switching the heating source off when the sensor detects a higher temperature than a first temperature threshold $S_1$ and switching the heating source on when the sensor detects a lower temperature than said first temperature threshold $S_1$.

Preferably, the value of the first threshold $S_1$ corresponds to the value detected by the temperature sensor in standby condition when the steam in the boiler reaches the desired pressure value (for example, 2 bar).

Advantageously, when the status of the steam delivery means switches from closed to open, the means for adjusting the pressure value in the boiler is suitable for switching the heating source on.

This allows the pressure loss in the boiler caused by steam delivery to be remedied immediately.

In fact, the Applicant notes that when the steam delivery means open, the boiler undergoes an immediate pressure loss. Such pressure loss causes a corresponding cooling of the water and of the heating source, and thus, a decrease in the temperature detected by the temperature sensor, with respect to the value of the first threshold $S_1$. However, the temperature detected by the probe decreases at a much slower rate than that at which the pressure decreases. Thus, without the switching of the heating source on upon the opening of the steam delivery means, the heating source would be switched on behind time with respect to the pressure loss, thus delaying the restoration of the desired pressure value.

Preferably, at the switching of the steam delivery means status from closed to open, the heating source is switched on with a predetermined delay with respect to the opening of the steam delivery means. This allows preventing useless switching on of the heating source in case of steam delivery lasting a non significant time.

Preferably, when the status of the steam delivery means is open, the means for adjusting the pressure value in the boiler is suitable for keeping the heating source on.

This allows remedying the pressure loss in the boiler caused by the steam delivery.

To this purpose, the Applicant notes that in steam delivery conditions, pressure and temperature are not connected to each other by a bi-univocal correspondence anymore; thus, it is not advantageous anymore to adjust the pressure value in the boiler in function of the temperature value detected by the sensor.

Advantageously, when the status of the steam delivery means switches from open to closed, the means for adjusting the pressure value in the boiler is suitable for keeping the heating source on for a predetermined time.

At the closure of the steam delivery means, this allows quickly restoring the pressure to the desired value in standby conditions.

In fact, the Applicant notes that during the steam delivery step in which the heating source is kept on by the pressure adjusting means, the water temperature present in the boiler is less than that detected by the temperature sensor. Thus, when the steam delivery step ends, the sensor detects a higher temperature than that effective of water, As a consequence, if it were not kept on for a predetermined period of time after closing the steam delivery means, the heating source would be switched on/off a certain number of times before the boiler returned to the standby saturation condition (in which the water temperature is almost equal to that detected by the sensor) with a consequent delay in restoring the desired pressure value.

Advantageously, said predetermined period of time is selected in function of the period of time in which the steam delivery means has been open.

Preferably, said predetermined period of time is selected in function of the boiler size, of the quantity of water contained therein, and of the heating source power.

For example, said period of time is about 3 times the opening time of the steam delivery means, and it has a maximum value of about 10s.

Advantageously, in steam delivery conditions, the control means of the appliance of the invention is suitable to switch the heating source off when the temperature detected by the temperature sensor is more than a second temperature threshold $S_2$.

This allows the control means to perform a heating source protection function. In fact, when the temperature value of the heating source increases above the value of the second threshold $S_2$, for example due to a failure of the water delivery means described below, they have the function of switching the heating source off.

The second threshold $S_2$ is advantageously higher than the above first threshold $S_1$. For example, $S_2$ is equal to about 165–170° C.

Advantageously, in steam delivery conditions, the control means of the appliance of the invention is also suitable to make the heating source be switched on again when the temperature detected by said temperature sensor is once again less than said threshold $S_2$.

In a variant, said control means is suitable to switch the heating source off/on when the temperature detected by the sensor is more/less than the second temperature threshold $S_2$, also when the status of the steam delivery means is closed. This allows performing the heating source protection function also when the steam delivery means status is closed. This may be useful, for example when, due to a failure, the means for adjusting the pressure value does not compare the temperature detected by the sensor with the first threshold $S_1$ anymore.

Typically, the appliance also comprises an atmospheric-pressure water tank.

Advantageously, the appliance also comprises means for feeding water from the tank to the boiler.

Typically, the control means of the appliance of the invention also comprises means for adjusting the water level in the boiler.

Preferably, said means for adjusting the water level in the boiler is operatively associated with the temperature sensor and to the water feeding means, so that the latter provide water to the boiler when the temperature sensor detects a higher temperature than a third temperature threshold $S_3$.

Moreover, the water feeding means advantageously interrupts the water inflow to the boiler when the temperature sensor detects a lower temperature than the third temperature threshold $S_3$.

Typically, the means for water feeding from the tank to the boiler comprises an electrical micro-pump. Advantageously, said electrical micro-pump is of the vibrating type.

Preferably, as the appliance of the invention is switched on, the water level adjusting means is suitable for driving said water feeding means so that they supply a quantity of water to the boiler. More preferably, said water level adjusting means is suitable for driving said feeding means when the appliance of the invention has been switched off for a long period of time. This aspect of the invention is advantageous since during the switching on step, when the water volume in the boiler is less than in standby conditions, it prevents the heating source from emerging from water, thus overheating. In fact, upon switching on, passing from an ambient temperature to a standby temperature (for example of 140–145° C.), the water in the boiler undergoes a volume expansion (generally, of at least 6%).

Moreover, the above feature allows the electrical micro-pump to be triggered before steam is generated in the boiler. This is advantageous for vibrating pumps since such pumps can exhibit triggering problems when the boiler is already pressurised.

Advantageously, the water tank comprises a sensor suitable for detecting the water level contained therein.

Preferably, when the water level detected by such sensor is less than a predetermined threshold value, the control means switches on a user warning light and deactivates the water feeding means and the heating source. This advantageously allows the need to fill the water tank to be signalled to the user and to prevent the water feeding means and the heating source from continuing to operate when the water in the tank is finishing.

Advantageously, when the water level detected by said sensor is less than said predetermined threshold value, said control means also provides for the closure of said steam delivery means. This allows the boiler to be kept ready to deliver steam again, preventing the user—that has not noticed the signalling warning light of the tank water level—from continuing to request steam delivery, thus emptying the boiler. In fact, emptying the boiler would cause a delay in restoring the appliance operating conditions, after filling the water tank, due to the time required by the boiler to be filled with water again and to the time required by water to be vaporised again at the desired conditions.

In a preferred embodiment, the heating source has an elevated portion.

Advantageously, the temperature sensor is suitable for detecting the temperature of the elevated portion of the heating source.

This embodiment is advantageous since when the water level in the boiler decreases, only the elevated portion of the heating source emerges from water, thus allowing the remaining part of the heating source to substantially operate immersed in water, preventing frequent increases of temperature of the entire heating source, which may impair its good operation and life.

Preferably, the elevated portion of the heating source extends along a predetermined direction.

Typically, the temperature sensor is contained in a protective envelope.

Advantageously, the temperature sensor protective envelope is in contact with the elevated portion of the heating source along a contact portion extending along said predetermined direction, so as to make the contact portion relatively wide.

This allows the sensor to be located with respect to the elevated portion in a more reliable way. In fact, for a correct operation of the appliance, the exact portion of the protective envelope in which the sensor is, must be welded on the elevated portion of the heating source. A minimum error in positioning the protective envelope on the elevated portion may cause a wrong positioning of the sensor with respect to the heating source.

Moreover, the relatively wide contact portion between the protective envelope and the elevated portion advantageously allows, when assembling the appliance of the invention, the positioning of the sensor inside the protective envelope and of the protective envelope with respect to the elevated portion of the heating source to be facilitated. In fact, a relatively wide contact portion allows the tolerances of such positionings to be increased.

Advantageously, the contact portion between said protective envelope and said elevated portion has an extension at least equal to 5 mm. Preferably, said extension is comprised between 5 and 30 mm. This allows to have a good margin for arranging the sensor protective envelope with respect to the elevated portion. Advantageously, said elevated portion extends in a substantially rectilinear manner.

According to an alternative, said elevated portion substantially extends according to a circumference arc.

Typically, said heating source is substantially U-shaped, comprising two substantially rectilinear and parallel opposed portions and a curvilinear portion connecting the two rectilinear portions.

In this case, said elevated portion is preferably located at one of the two rectilinear portions of said U-shape.

According: to an alternative, said elevated portion is located at the curvilinear portion of said U-shape.

According to an alternative, said heating source can, for example, be shaped as a U folded on itself, or as a spiral.

The size of the heating source is advantageously selected in function of the desired power and of the size of the boiler intended to contain it.

Preferably, said protective envelope is welded along said elevated portion. More preferably, said protective envelope is welded along an upper part of said elevated portion. In this way, the elevated portion of the heating source is prevented from emerging from water before the temperature sensor and, thus, from undergoing an increase of temperature without the sensor detecting it correctly.

Preferably, said welding is performed through brazing. This advantageously allows avoiding, in the course of time, limestone deposits along the contact portion between the thermal source and the protective envelope, and thus a decrease in the sensor sensitivity.

Advantageously, said protective envelope has an elongated body. Typically, said envelope is a stainless steel tube.

Typically, said heating source is an electrical resistor. Advantageously, the boiler also comprises a fuse. Preferably, said fuse is welded on said elevated portion, in opposed position with respect to said temperature sensor. The fuse is suitable to bum and thus to deactivate the heating source when it reaches a predetermined dangerous temperature (for example equal to about 190° C.). This allows the appliance of the invention to be protected from excessive temperature increases of the heating source—due, for example, to a failure of the temperature sensor or of the water feeding means—which may be dangerous.

In a second aspect thereof, the present invention relates to a method for adjusting the steam pressure in a boiler, comprising a heating source intended to be at least partly immersed in water for water vaporisation, said boiler being associated with steam delivery means, said method comprising the steps of a) powering the heating source at the appliance switching on;

b) switching the heating source on/off so as to maintain the steam pressure in the boiler at a desired value, characterised in that it also comprises the step c) of checking the open/closed status of the steam delivery means, and in that step b) is carried out in function of the open/closed status detected in step c).

According to the method of the invention, the steam pressure in the boiler is maintained at a desired value by operating on the switching on/off of the heating source in function of the open/closed status of the steam delivery means.

This allows the pressure of a boiler to be adjusted without a direct detection of the pressure value, thus avoiding the expensive and relatively bulky use of a manometer.

Preferably, when the status detected in step c) is closed, step b) is carried out according to a step b2) of detection of the heating source temperature and of switching on/off of the heating source in function of the detected temperature.

Typically, step b2) is carried out switching the heating source off when the detected temperature value is more than a first threshold temperature $S_1$.

Typically, step b2) is further carried out switching the heating source on when the detected temperature value Is less than the first threshold temperature $S_1$.

Advantageously, when in step c) a passage from closed to open of the steam delivery means is detected, step b) is carried out according to a step b3) of switching the heating source on.

Preferably, in step b3) the heating source is switched on with a predetermined delay with respect to the passage of the steam delivery means from closed to open.

Preferably, when the status detected in step c) is open, step b) is carried out through a step b4) according to which the heating source is kept on.

Advantageously, when in step c) a passage from open to closed of the steam delivery means is detected, step b) is carried out through to a step b5) according to which the heating source is kept on for a predetermined period of time.

Advantageously, when the status detected in step c) is open or when in step c) a passage from open to closed or from closed to open of the steam delivery means is detected, the method of the invention also comprises the step d) of detecting the temperature of the heating source and switching the heating source off when the detected temperature value is more than a second temperature threshold $S_2$. According to an embodiment, step d) is carried out also when the steam delivery means status detected in step c) is closed.

Further features and advantages of the present invention will appear more clearly from the following detailed description of a preferred embodiment, made with reference to the attached drawings. In such drawings, FIG. 1 shows a schematic representation of an embodiment of an appliance according to the invention;

Figure 1:
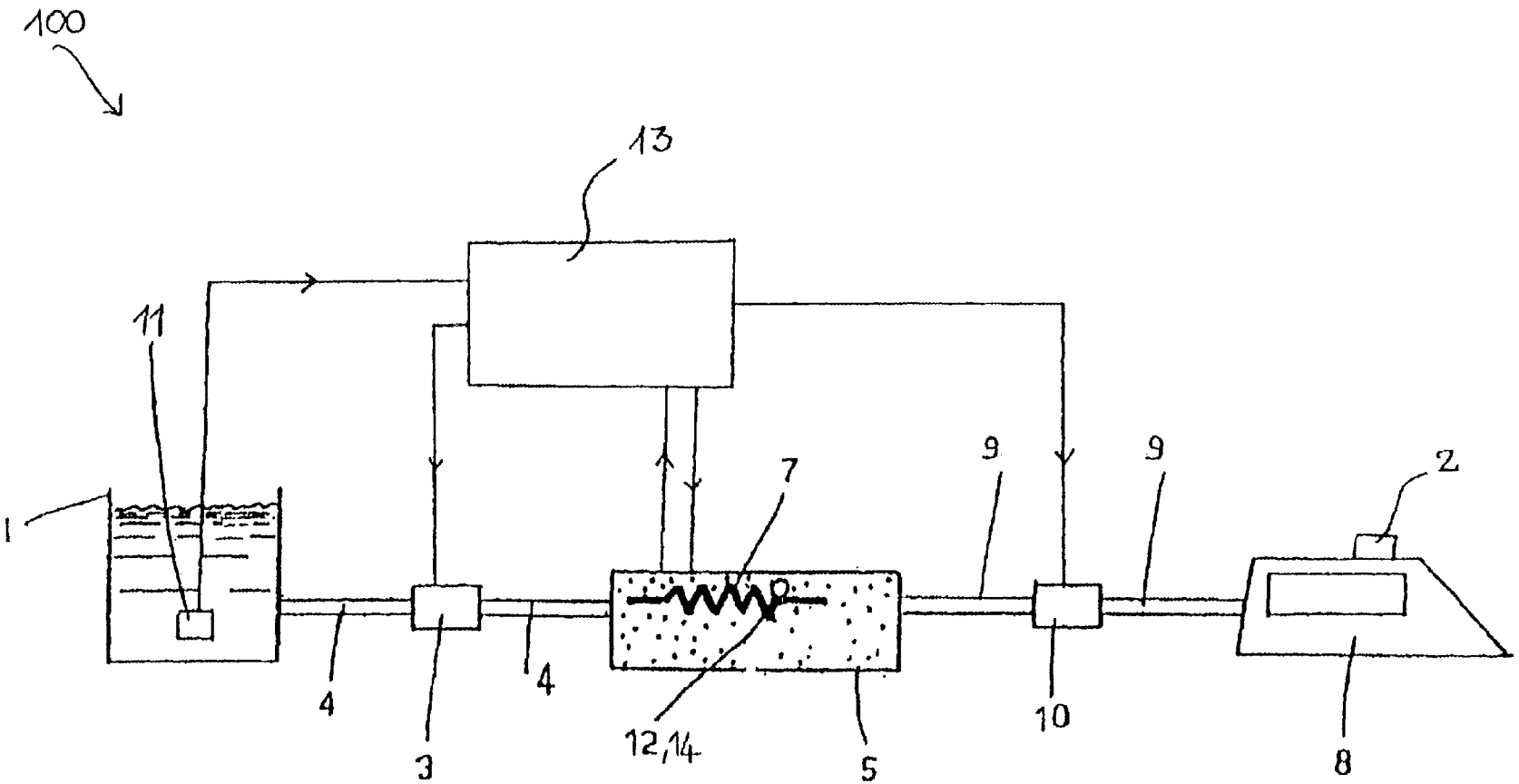

FIG. 1 shows an embodiment of a household appliance 100 for steam generation according to the invention. It comprises an atmospheric pressure water tank 1, a boiler 5, water feeding means 4, 3 from tank 1 to boiler 5, steam delivery means 9, 10 from boiler 5 to a steam-using equipment 8, and control means 13.

A typical example of a steam—using equipment 8 consists of an iron, or an apparatus for cleaning floors, sofas, bathrooms, curtains, glasses.

Typically, the steam—using equipment 8 is provided with an indicator light (not shown) suitable for signalling to the user when the boiler 5 is in standby conditions and is thus ready to deliver steam.

Moreover, the user equipment 8 is provided with a steam delivery, button 2 which allows the user to request steam delivery and to act on the steam delivery means 9, 10 so that they allow the passage of steam from boiler 5 to the user equipment 8.

The water feeding means 4, 3 comprises a micro-pump 3 and two water ducts 4, one for connecting tank 1 to pump 3 and one for connecting pump 3 to boiler 5. In the illustrated embodiment, pump 3 is of the vibrating type.

The steam delivery means 9, 10 comprises a solenoid valve 10 and two water ducts 9, one for connecting boiler 5 to the solenoid valve 10 and one for connecting the solenoid valve 10 to the steam—using equipment 8.

The water tank 1 is, for example, a plastic container suitable for containing cold water, at ambient temperature. It advantageously comprises a conventional level sensor 11 suitable for detecting the water level in tank 1.

Figure 2:
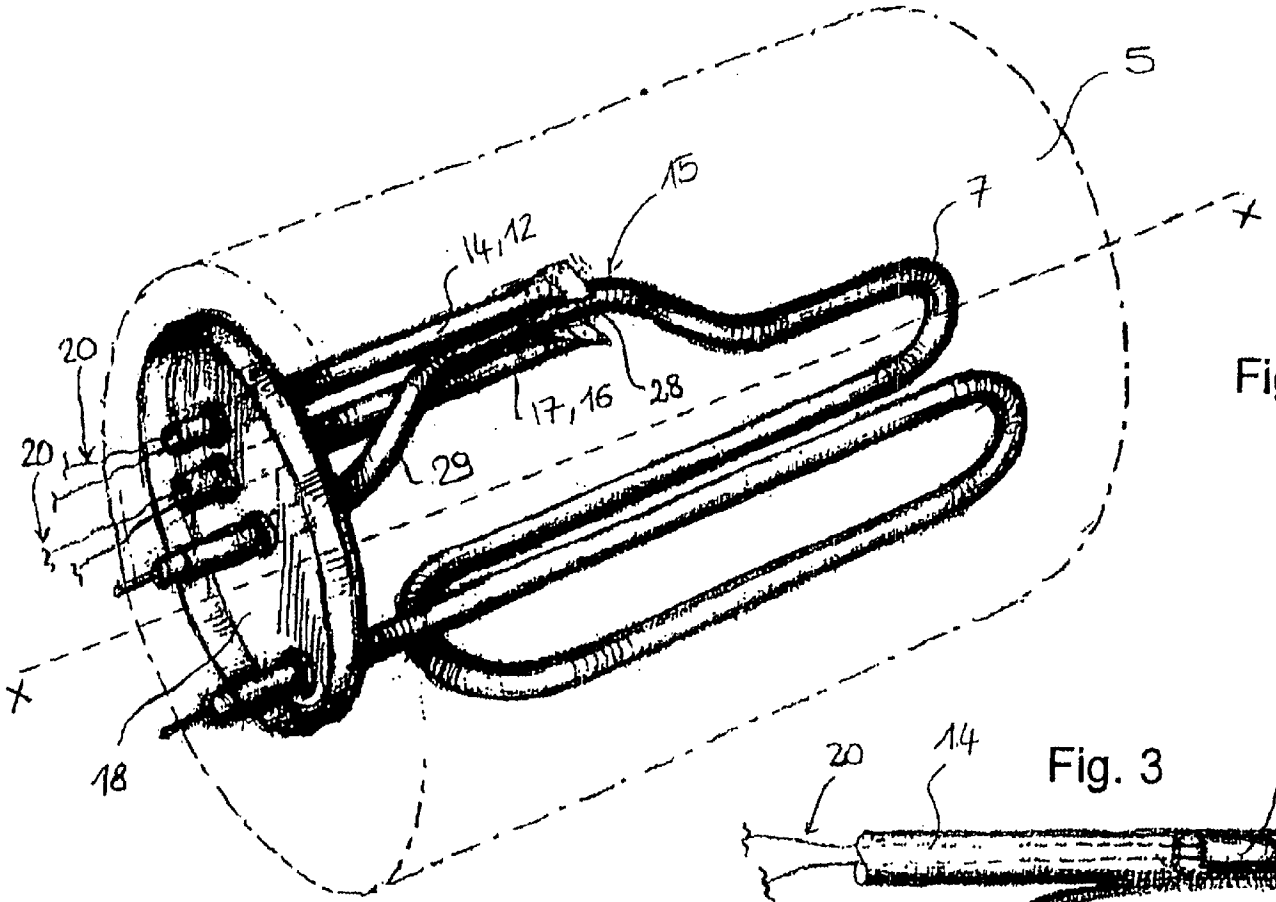
FIG. 2 shows a perspective view of an, embodiment of a boiler of the appliance of FIG. 1.

As shown in FIG. 2, boiler 5 consists of a cylindrical container, having a longitudinal axis of symmetry xx, with two bottoms (not shown) screwed or welded to its two ends.

Boiler 5 comprises a heating source 7 for water vaporisation, a temperature sensor 12 suitable for detecting the temperature of the heating source 7, and a protection fuse 16.

The temperature sensor 12 and fuse 16 are contained in two respective protective envelopes 14 and 17, together with electrical wires 20 for connection to the control means 13. Such envelopes 14 and 17 are two stainless steel tubes allowing the protection of sensor 12 and fuse 16 from water infiltration. At one end, they are closed through squashing or welding, and at the opposite end, they are welded to a flange 18 for connection to one of the two bottoms of boiler 5.

The heating source 7 is an armoured electrical resistor.

The two ends of such an electrical resistor are also welded to flange 18, as shown in FIG. 2.

According to the embodiment of FIG. 2, the electrical resistor 7 is shaped as a U folded on itself, which mainly extends along a longitudinal direction parallel to axis xx of boiler 5. Moreover, in the proximity of flange 18, the electrical resistor 7 has an elevated portion 15 extending in a substantially parallel manner with respect to the symmetry axis xx.

More in particular, as shown in FIG. 2, the elevated portion 15 has a rectilinear portion 28 and a curved portion 29 in the proximity of flange 18. The curved portion advantageously allows the connection of the two ends of envelopes 14 and 17 and the end of the electrical resistor 7 comprised between them to flange 18 to be facilitated.

Envelope 14 of sensor 12 and envelope 17 of fuse 16 are welded (preferably through brazing) along most of the rectilinear portion 28 of the elevated portion 15, so as to obtain a relatively wide contact portion having a length comprised between about 5 and 30 mm.

As already said above, a relatively wide contact portion allows to make the positioning of the sensor with respect to the elevated portion more reliable and to facilite, when assembling the appliance of the invention, the positioning of the sensor inside the protective envelope and of the protective envelope on the elevated portion of the heating source.

Figure 3:
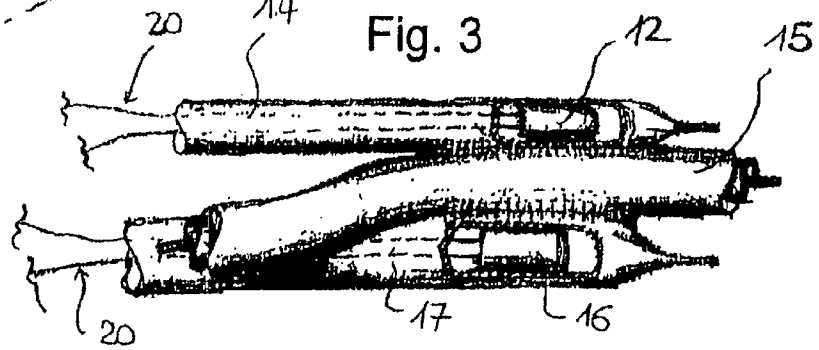
FIG. 3 shows a partially sectioned side view of an elevated portion of a heating source of the boiler of FIG. 2, with a temperature sensor and a fuse welded on it.

More in particular, envelope 14 of the temperature sensor 12 is welded on the rectilinear portion 28 of the elevated portion 15, and envelope 17 of fuse 16 therunder (in opposed position with respect to envelope 14) so that sensor 12 and fuse 16 are in correspondence with the contact portion between the protective envelopes 14 and 17 and the elevated portion 15 (FIG. 3).

Figure 4:
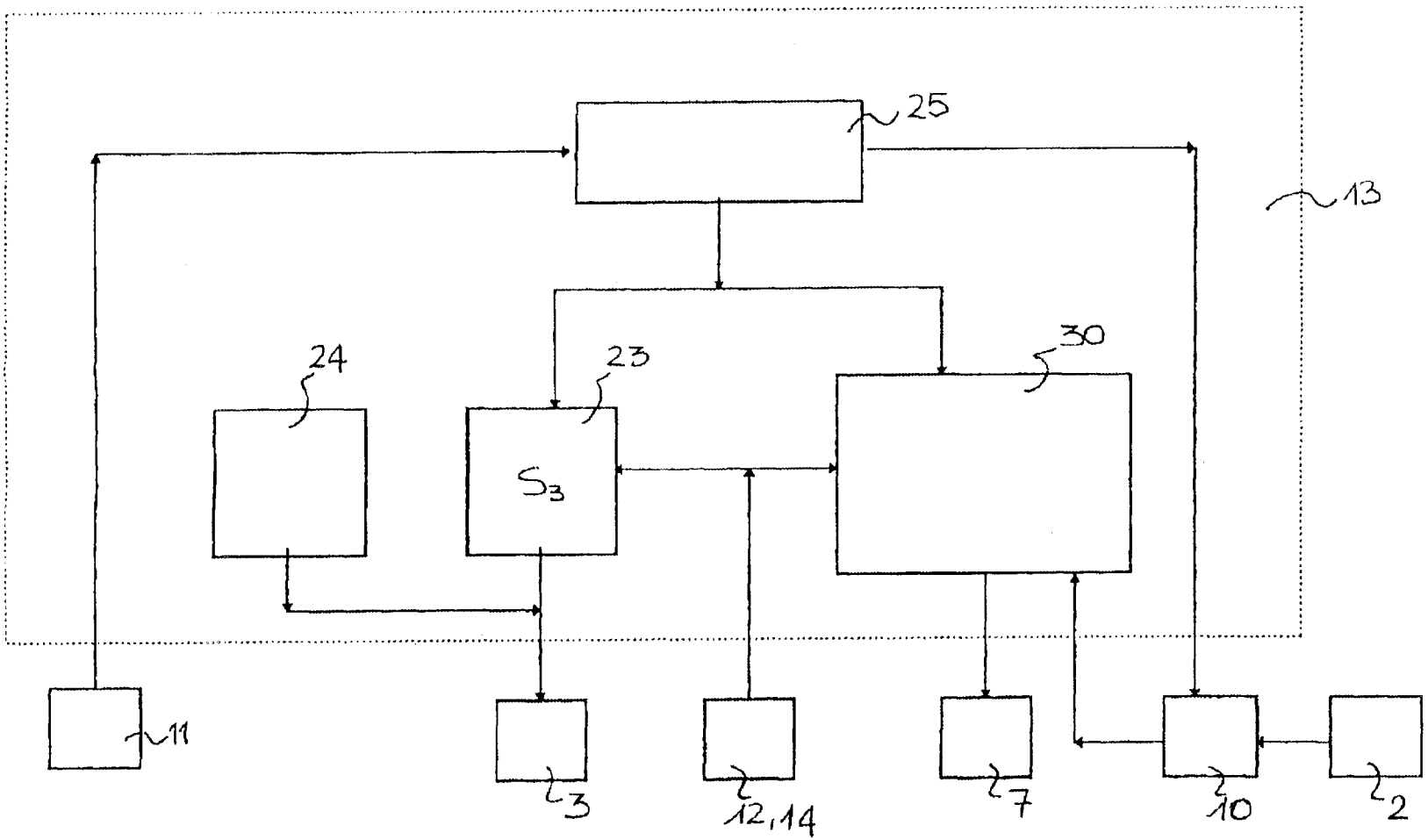
FIG. 4 shows a schematic representation of control means of the appliance of FIG. 1.

FIG. 4 schematically shows the control means 13 comprising third 23, fourth 24 and fifth 25 circuit blocks, and means 30 for adjusting the pressure value in boiler 5.

Figure 5:
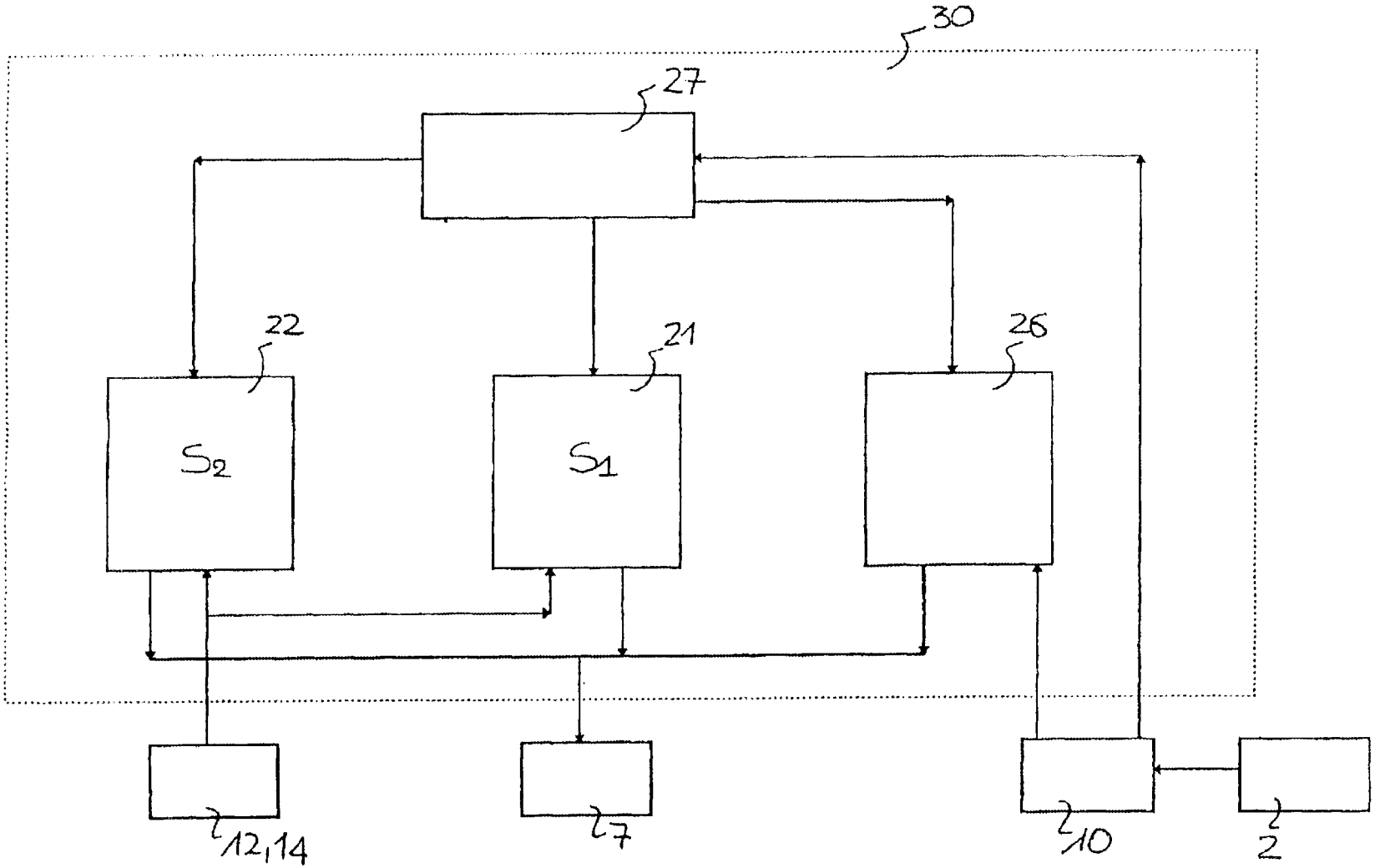
FIG. 5 shows a schematic representation of means for adjusting the pressure value comprised in the control means of FIG. 4.

In turn, FIG. 5 schematically shows means 30 for adjusting the pressure value in boiler 5, comprising first 21, second 22, sixth 26 and seventh 27 circuit blocks.

The seventh circuit block 27 makes the circuit blocks 21, 22 and 26 active or inactive in function of the open/closed status of the solenoid valve 10.

More in particular, when the solenoid valve 10 is closed; the seventh circuit block 27 makes the first circuit block 21 active and the sixth circuit block 26 and the second circuit block 22 inactive, whereas when the solenoid valve 10 is open, or is in its opening or closing transient, the seventh circuit block 27 makes the sixth circuit block 26 and the second circuit block 22 active and the first circuit block 21 inactive.

The first circuit block 21, operating when solenoid valve 10 is closed, is suitable for comparing the temperature detected from time to time by the temperature sensor 12 with a first temperature threshold $S_1$. When the detected temperature is more than said threshold $S_1$, it switches resistor 7 off (or keeps it off), whereas when the detected temperature is less than $S_1$, it switches it on (or keeps it on).

Threshold $S_1$ corresponds to the temperature value detected in standby condition when the steam in the boiler reaches the desired nominal pressure value (for example, 2 bar).

For example, threshold $S_1$ is equal to about 145° C.

The first circuit block 21 is thus suitable for switching resistor 7 on/off, in function of the temperature value detected by sensor 12, so as to maintain the steam generated in boiler 5 at the desired pressure value P, through the heating of resistor 7.

Typically, the comparison of the temperature detected by the temperature sensor 12 is realised through a conventional hysteresis cycle, or Schmitt trigger, using two thresholds $S_1$ and $S_1'$, with $S_1>S_1'$ (for example, respectively equal to about 145 and 143° C.)'. The first threshold is used for switching resistor 7 off (or keeping it off) when the temperature detected by sensor 12 is more than or equal to, such threshold; the second threshold is used for switching resistor 7 on (or keeping it on) when the temperature detected by sensor 12 is less than or equal to such threshold.

When the temperature detected by sensor 12 is more than or equal to threshold $S_1$, the indicator light suitable to signal the user that boiler 5 is in standby conditions (that is, it is ready to deliver steam) is switched on.

With reference to the operation of the first circuit block 21, the Applicant notes that in standby conditions, the temperature detected by sensor 12 is equivalent to that of the water, since the system has achieved the equilibrium, and resistor 7, during the periods of time in which it is off, does not affect the temperature detected by sensor 12. Thus, as already said above, it is possible to maintain the desired pressure value in function of the temperature value detected by sensor 12.

On the other hand, during the initial period of heating of appliance 100, sensor 12 detects a temperature that is the result of the temperature of water, and that (higher) of resistor 7. The water temperature thus is lower than that detected by sensor 12. As a consequence, as appliance 100 is switched on:

1) resistor 7 is switched on;
2) when sensor 12 detects a higher temperature than that of threshold $S_1$, the first circuit block 21 switches resistor 7 off (at this point, water has a lower temperature/pressure than the nominal standby one);
3) resistor 7 cools down transferring, heat to the water and, when sensor 12 again detects a lower temperature than that of threshold $S_1$, the first circuit block 21 switches resistor 7 on again;
4) steps 2 and 3 are repeated with an ON cycle (resistor 7 on) which progressively becomes shorter, and an OFF cycle (resistor 7 off), which progressively becomes longer, until the standby nominal pressure value is reached (asymptotically).

Should a user require steam delivery during one of the above steps, when pressure in boiler 5 has not reached the desired nominal value yet, the sixth circuit block 26 would in any case bring the steam pressure to the desired nominal value, since it is suitable—as described hereinafter—for keeping resistor 7 on during the opening time of solenoid valve 10.

The sixth circuit block 26, operating when solenoid valve 10 is open, or is in its opening or closing transient, is suitable for switching resistor 7 on at the opening of the solenoid valve 10;

keeping resistor 7 on during the opening period of solenoid valve 10;

keeping resistor 7 on for a predetermined period of time after the closing of solenoid valve 10;

These steps allow the pressure value of boiler 5 to be adjusted when it is in steam delivery conditions.

In fact, the Applicant notes that In steam delivery conditions, resistor 7 affects the temperature detected by sensor 12 in direct contact with it; thus, it is not advantageous anymore to adjust the pressure value in function of the temperature value detected by sensor 12, as in standby conditions.

Preferably, at the opening of the solenoid valve 10, resistor 7 is switched on with a predetermined delay (for example, of 0.5 s) so as to prevent useless switching on of resistor 7 in case of steam delivery lasting a non significant time.

The predetermined period of time during which resistor 7 is kept on after the closing of solenoid valve 10 is, for example, about 3 times that of steam delivery, and less than or equal to, about 10 s.

The second circuit block 22, operating when solenoid valve 10 is open, or is in its opening or closing transient, is suitable for comparing the temperature from time to time detected by the temperature sensor 12 with a second predetermined temperature threshold $S_2$, and for switching resistor 7 off (or keeping it off) when the temperature detected by said temperature sensor 12 exceeds said threshold $S_2$, and it is suitable for making resistor 7 be switched on again when the temperature detected by said temperature sensor 12 is less than said threshold $S_2$ again.

The second threshold $S_2$ is higher than the above first threshold $S_1$. For example, $S_2$ is equal to around 165–170° C.

The second circuit block 22 has a resistor protection function. In fact, when the temperature value of resistor 7 increases above the value of the second threshold $S_2$, for example due to a failure of the water delivery means 3, 4, it has the function of switching resistor 7 off.

In a variant, the second circuit block 22 operates also when solenoid valve 10 is closed, so as to perform its resistor protection function also in case the first circuit block 21 is broken and does not compare the temperature detected by sensor 12 with the first threshold $S_1$ anymore.

Typically, similarly to what was said above for the first circuit block 21, the comparison with the temperature detected by the temperature sensor 12 is realised through a conventional hysteresis cycle, or Schmitt trigger, using two thresholds $S_2$ and $S_2'$, with $S_2>32'$ (for example, respectively equal to about 165 and 163° C.). The first threshold is used for switching resistor 7 off when the temperature detected by sensor 12 is more than or equal to such threshold; the second threshold is used to make resistor 7 switch on again when the temperature detected by sensor 12 is again less than or equal to such threshold.

Figure 6:
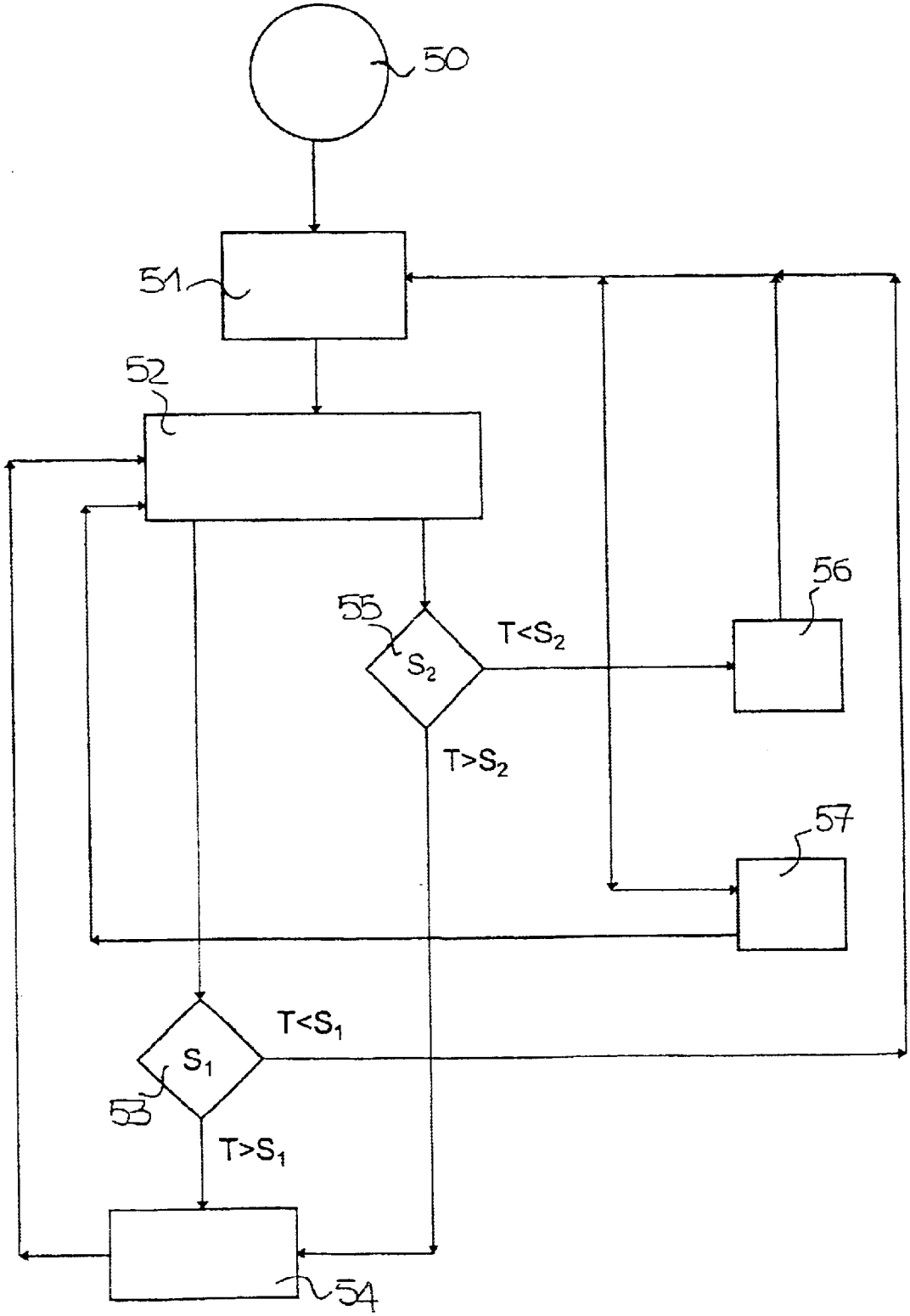
FIG. 6 shows a flow chart exemplifying the operation of the means of FIG. 5.

FIG. 6 shows a flow chart describing an example of operation of means 30 for adjusting the pressure value in boiler 5.

As the household appliance 100 is switched on (block 50), resistor 7 is switched on (block 51), and the open/closed status of solenoid valve 10 is controlled (block 52).

If the solenoid valve is closed, the seventh circuit block 27 makes the first circuit block 21 active and makes it to compare the temperature detected by sensor 12 with the first threshold $S_1$ (block 53).

If the temperature detected by sensor 12 is less than the first threshold $S_1$, the first circuit block 21 switches resistor 7 on (or keeps it on, block 51).

If the temperature detected by sensor 12 is more than the first threshold $S_1$, the first circuit block 21 switches resistor 7 off (or keeps it off, block 54), and then returns to block 52.

If the control performed in block 52 shows that the solenoid valve is open, or is in its opening or closing transient, the second circuit block 22 performs the comparison between the temperature detected by sensor 12 and the second threshold $S_2$ (block 55).

If the temperature detected by sensor 12 is more than the second threshold $S_2$, the second circuit block 22 switches resistor 7 off (or keeps it off, block 54), and returns to block 52.

If the temperature detected by sensor 12 is less than the second threshold $S_2$, the sixth circuit block 26 switches resistor 7 on (or keeps it on, block 51) if the control performed in block 52 has shown that solenoid valve 10 is open;

switches resistor 7 on with a predetermined delay (blocks 56 and 51) if the control performed in block 52 has shown that solenoid valve 10' is in its opening transient;

keeps resistor 7 on for a predetermined period of time after the closing of solenoid valve 10 (block 57) and returns to block 52, if the control performed in block 52 has shown that solenoid valve 10 is in its closing transient.

The operation of means 30 for adjusting the pressure value in boiler 5 ends, in any point of the flow chart of FIG. 6, when the household appliance 100 is switched off (with consequent switching off of resistor 7).

Resuming the description of the control means 13 of FIG. 4, the third circuit block 23 is suitable for comparing the temperature detected from time to time by the temperature sensor 12 with a third temperature threshold $S_3$, and for commanding pump 3 so as to provide a quantity of water to boiler 5 when the temperature detected by said temperature sensor 12 is more than said threshold $S_3$. Such quantity of water is provided to boiler 5 for cooling resistor 7 until the temperature detected by sensor 12 is less than threshold $S_3$ again.

The third threshold $S_3$ is higher than the first threshold $S_1$. For example, $S_3$ is equal to about 155° C.

The third circuit block 23 is thus suitable for commanding pump 3 each time that, due to a steam delivery, the water level in boiler 5 decreases, the protective envelope 14 of sensor 12 and the elevated portion 15 emerge from water, and sensor 12 detects a higher temperature than the third threshold $S_3$.

In fact, when the elevated portion 15 emerges from water, sensor 12 in direct contact with it detects its increase of temperature due to the change of the thermal exchange coefficient (which, from metal-water becomes metal-steam).

Typically, the comparison with the temperature detected by sensor 12 occurs through a conventional hysteresis cycle, or Schmitt trigger, using two temperature thresholds $S_3$ and $S_3'$, with $S_3>S_3'$ (for example, respectively equal to about 155 and 153° C.). When the temperature detected by sensor 12 is more than or equal to, threshold $S_3$, the third circuit block 23 is suitable for commanding pump 3 so as to provide water to boiler 5. In turn, when the temperature detected by sensor 12 is less than or equal to threshold $S_3'$, the third circuit block 23 is suitable for commanding pump 3 so as to block the water inflow to boiler 5.

The fourth circuit block 24 comprises a timer, and it is suitable for actuating pump 3 for a predetermined period of time as the household appliance 100 is switched on, after it has been off for a predetermined period of time.

The fourth block 24 therefore allows the resistor 7 to be prevented from emerging from water, thus overheating, during the switching on of appliance 100, when the water volume in boiler 5 is less than in standby conditions.

Moreover, it allows the electrical micro-pump 3 to be triggered when boiler 5 is not pressurised yet. This is an advantageous aspect since, after appliance 100 has been off for a predetermined period of time, pump 3 tends to deactivate, and vibrating pumps can exhibit triggering problems when boiler 5 is already in pressure.

The fifth circuit block 25 is suitable for comparing the water level of tank 1, detected by the level sensor 11, with a predetermined threshold. When the water level is less than said threshold, the fifth block 25 is suitable for switching a warning light (not shown) on to signal to the user that tank 1 must be filled, and for blocking the supply to the third circuit block 23 and to the means 30 for adjusting the pressure value (circuit blocks 21, 22 and 26), so as to switch both pump 3 and resistor 7 off. Moreover, in the illustrated preferred embodiment, the fifth block 25 is also suitable for switching solenoid valve 10 off.

When the user has filled tank 1 with water and the water level of tank 1 is more than the above threshold again, the fifth block 25 is suitable for switching the user signalling warning light off, powering circuit blocks 21, 22, 23, 26 again, and switching solenoid valve 10 on again.

By also switching solenoid valve 10 off, the fifth block 25 prevents the user from continuing to use the steam, thus emptying boiler 5, in case he does not notice the switching on of the warning light.

Thus, when the water tank 1 is filled within a few minutes, the fifth block 25 makes the steam present in boiler 5 to remain at the desired pressure and the boiler to be ready to operate again as soon as tank 1 is filled with water and the fifth block 25 switches blocks 21., 22 and 23, 26 and -25-solenoid valve 10 on.

If, on the other hand, solenoid valve 10 were not switched off and the user continued to require steam, when the operation of appliance 100 is restored, boiler 5 would have to be supplied with a relatively large quantity of cold water, thus causing a delay in reaching the standby conditions, due to the time required by water for reaching the desired steam pressure.

What is claimed is:

1. A household appliance (100) for steam generation, comprising a boiler (5) comprising, in turn, a heating source (7) for water vaporisation intended to be at least partly immersed in water, control means (13) comprising, in turn, means (30) for adjusting the pressure value of the steam in the boiler (5) , said means (30) being operatively associated with the heating source (7) to switch it on/off so as to maintain the steam pressure at a desired value, steam delivering means (9, 10), characterized in that the means (30) for adjusting the pressure value in the boiler (5) is operatively associated with the steam delivery means (9, 10) so as to switch the heating source (7) on/off in function of the open/closed status of the steam delivery means (9, 10).

2. A household appliance (100) according to claim 1, wherein the boiler (5) also comprises a temperature sensor (12) suitable for detecting the temperature of the heating source (7).

3. A household appliance (100) according to claim 2, wherein the means (30) for adjusting the pressure value in the boiler (5) is operatively connected to the temperature sensor (12) so as to switch the heating source (7) on/off in function of the temperature value detected by the sensor (12), when the status of the steam delivery means (9, 10) is closed.

4. A household appliance (100) according to claim 1, wherein when the status of the steam delivery means (9, 10) switches from closed to open, the means (30) for adjusting the pressure value in the boiler (5) is suitable for switching the heating source (7) on.

5. A household appliance (100) according to claim 4, wherein the heating source (7) is switched on with a predetermined delay with respect to the opening of the steam delivery means (9, 10).

6. A household appliance (100) according to claim 1, wherein when the status of the steam delivery means (9, 10) is open, the means (30) for adjusting the pressure valve in the boiler (5) is suitable for keeping the heating source (7) on.

7. A household appliance (100) according to claim 1, wherein when the status of the steam delivery means (9, 10) switches from open to closed, the means (30) for adjusting the pressure value in the boiler (5) is suitable for keeping the heating source (7) on for a predetermined period of time.

8. A household appliance (100) according to claim 7, wherein said predetermined period of time is selected in function of the period of time in which the steam delivery means (9, 10) has been open.

9. A household appliance (100) according to claim 2, wherein the control means (13) is suitable for switching the heating source (7) off when the temperature detected by the temperature sensor (12) is more than a predetermined temperature threshold $S_2$.

10. The method for adjusting the steam pressure in a boiler (5) comprising a heating source (7) intended to be at least partly immersed in water for water vaporisation, said boiler (5) being associated with steam delivery means (9, 10), said method comprising the steps of a) powering the heating source (7) at the switching of the appliance (100);

b) switching the heating source (7) on/off so as to maintain the steam pressure in the boiler (5) at the desired value, characterised in that it also comprises the step c) of checking the open/closed status of the steam delivery means (9, 10), and in that step b) is carried out in function of the open/closed status detected in step c).

11. Method according to claim 10, wherein, when the status detected in step c) is closed, step b) is carried out according to a step b2) of detecting the temperature of the heating source (7) and of switching the heating source (7) on/off in function of the detected temperature.

12. Method according to claim 10, wherein when in step c) a passage from closed to open of the steam delivery means (9, 10) is detected, step b) is carried out according to a step b3) of switching the heating source (7) on.

13. Method according to claim 12, wherein in step b3) the heating source (7) is switched on with a predetermined delay with respect to the passage of the steam delivery means (9, 10) from closed to open.

14. Method according to claim 10 wherein, when the status detected in step c) is open, step b) is carried out through a step b4) according to which the heating source (7) is kept on.

15. Method according to claim 10, wherein when in step c) a passage from open to closed of the steam delivery means is detected, step b) is carried out through to a step b5) according to which the heating source (7) is kept on for a predetermined period of time.

16. Method according to claim 10, also comprising the step d) of detecting the temperature of the heating source (7) and switching the heating source (7) off when the detected temperature value is more than a predetermined temperature threshold $S_2$.

* * * * *